US010503111B2

(12) United States Patent
Sakaguchi et al.

(10) Patent No.: US 10,503,111 B2
(45) Date of Patent: Dec. 10, 2019

(54) IMAGE FORMING APPARATUS FOR DISPLAYING A SCREEN TO PROMPT A USER TO RE-ATTACH A CONTAINER HAVING DEVELOPING MATERIAL

(71) Applicant: CANON KABUSHIKI KAISHA, Tokyo (JP)

(72) Inventors: Ryou Sakaguchi, Toride (JP); Toshifumi Oikawa, Tsukubamirai (JP); Hiroyuki Eda, Moriya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/945,266

(22) Filed: Apr. 4, 2018

(65) Prior Publication Data

US 2018/0299815 A1 Oct. 18, 2018

(30) Foreign Application Priority Data

Apr. 13, 2017 (JP) ..... 2017-079955

(51) Int. Cl.
*G03G 15/00* (2006.01)
*G03G 15/08* (2006.01)

(52) U.S. Cl.
CPC ..... *G03G 15/556* (2013.01); *G03G 15/0867* (2013.01); *G03G 15/5016* (2013.01)

(58) Field of Classification Search
CPC ..... G03G 15/556; G03G 15/5016; G03G 15/0877; G03G 15/0865–0868; G03G 15/553; G03G 15/502; H04N 1/32635; H04N 1/32651; H04N 1/32657
USPC ..... 399/24, 27, 13, 81
See application file for complete search history.

(56) References Cited

U.S. PATENT DOCUMENTS 8,135,299 B2 * 3/2012 Peters ..... G03G 15/221 399/81
8,565,624 B2 * 10/2013 Matsukawa ..... G03G 15/0894 399/102
2005/0231639 A1 * 10/2005 Kubota ..... H04N 1/00283 348/552
2006/0045546 A1 3/2006 Okochi
2012/0268771 A1 * 10/2012 Kruizinga ..... H04N 1/00029 358/1.14
2013/0223855 A1 * 8/2013 Ajima ..... G03G 15/556 399/27
2014/0153027 A1 * 6/2014 Nakamura ..... H04N 1/00663 358/1.14

(Continued)

*Primary Examiner* — Walter L Lindsay, Jr.
*Assistant Examiner* — Arlene Heredia
(74) *Attorney, Agent, or Firm* — Canon U.S.A., Inc. IP Division

(57) ABSTRACT

An apparatus includes an image forming unit configured to form an image with a developing material; a mounting unit having a container mounted therein, the container containing the developing material; a controller configured to determine a remaining amount of the developing material in the container and determine a replenishing error of the container; and a display unit configured to display, in a state where a first condition is satisfied, a screen to prompt a reattachment of the container detached from the mounting unit while the container is not in the mounting unit, and display, in a state where a second condition is satisfied, a screen to prompt an execution of an operation for solving the replenishing error while the container is not in the mounting unit.

20 Claims, 13 Drawing Sheets

(56) References Cited

U.S. PATENT DOCUMENTS

| | | | | |
|---|---|---|---|---|
| 2014/0160511 | A1* | 6/2014 | Yamada | H04N 1/00408 358/1.14 |
| 2015/0071657 | A1* | 3/2015 | Kakutani | G03G 21/1676 399/13 |
| 2015/0071659 | A1* | 3/2015 | Iikura | G03G 21/1676 399/27 |
| 2015/0355573 | A1* | 12/2015 | Jeong | G03G 15/0862 399/58 |

* cited by examiner

FIG. 8

△ STILL USABLE TONER BOTTLE OF FOLLOWING COLOR IS DETACHED.

• YELLOW

PLEASE RESET DETACHED TONER BOTTLE.
PLEASE CONSIDER EFFECTIVE UTILIZATION OF LIMITED RESOURCES.

IMAGE FORMING APPARATUS FOR DISPLAYING A SCREEN TO PROMPT A USER TO RE-ATTACH A CONTAINER HAVING DEVELOPING MATERIAL

BACKGROUND OF THE INVENTION

Field of the Invention

The aspect of the embodiments relates to an image forming apparatus in which a container containing a developing material is detachable.

Description of the Related Art

An image forming apparatus of an electrophotographic method forms an image by developing an electrostatic latent image formed on a photosensitive member by a developing material in the developer. Since there is a limit of an amount of the developing material that can be accumulated in the developer, the developing material is replenished to the developer according to need from a container, which is detachable to the image forming apparatus.

Since there is also a limit of the developing material in the container, the developing material cannot be replenished from the container to the developer when there is no more developing material in the container. Thus, when there is no more developing material in the container, the image forming apparatus notifies a user that the container is to be replaced.

However, the user may sometimes replace the container even when the amount of the developing material in the container is equal to or greater than a predetermined amount. In this point of view, an image forming apparatus according to US Patent Laid-Open No. 2006/0045546 displays a screen to warn that there is still some developing material in a container if the container is detached before the container becomes empty. According to the image forming apparatus described in US Patent Laid-Open No. 2006/0045546, since the user is notified that it is not a timing to replace the container, it is prevented that the container, which still contains some developing material, is replaced.

According to the image forming apparatus described in US Patent Laid-Open No. 2006/0045546, a warning screen is displayed at a timing the container is detached, even when the container is to be taken out before the container becomes empty. For example, when the developing material in the container is agglutinated, the developing material may not be properly replenished from the container. In this case, by loosening the agglutinated developing material in the container, the developing material can be properly replenished from the container. This causes a situation that the user is to take out the container once, loosen the developing material in the container, and reattach the container.

However, according to the image forming apparatus described in US Patent Laid-Open No. 2006/0045546, when the container is taken out while there is still some developing material in the container, the warning screen is automatically displayed. Thus, the user may reattach the container without loosening the agglutinated developing material in the container. In this case, it remains in a situation that the container cannot properly perform a replenishment. In other words, the image forming apparatus described in US Patent Laid-Open No. 2006/0045546 may cause a reduced usability

SUMMARY OF THE INVENTION

An apparatus includes an image forming unit configured to form an image with a developing material; a mounting unit configured to have a container, which contains the developing material to be replenished to the image forming unit, mounted therein; a controller configured to determine a remaining amount of the developing material in the container and determine a replenishing error of the container; and a display unit configured to display, in a state where a first condition is satisfied, a screen to prompt a reattachment of the container detached from the mounting unit while the container is not in the mounting unit, and display, in a state where a second condition is satisfied, a screen to prompt an execution of an operation for solving the replenishing error while the container is not in the mounting unit. The first condition is satisfied in a case where the remaining amount is greater than a predetermined amount and the replenishing error is not detected, and the second condition is satisfied in a case where the remaining amount is greater than the predetermined amount and the replenishing error is detected.

Further features of the disclosure will become apparent from the following description of exemplary embodiments (with reference to the attached drawings).

BRIEF DESCRIPTION OF THE DRAWINGS

FIG. 8 is a schematic view of a warning screen.

DESCRIPTION OF THE EMBODIMENTS (Description of Image Forming Apparatus)

Figure 1:
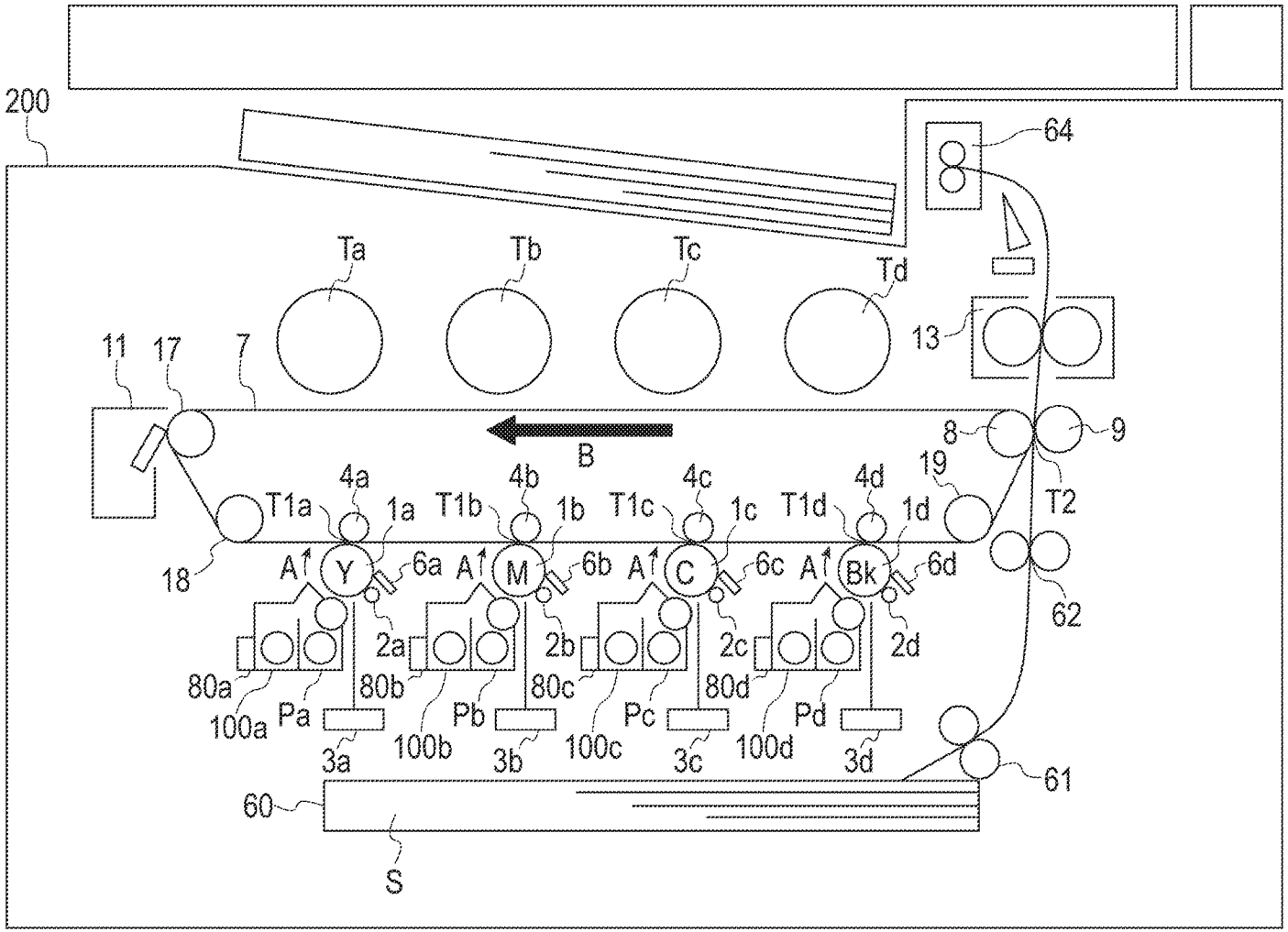
FIG. 1 is an outline sectional view of an image forming apparatus.

FIG. 1 is an outline sectional view of an image forming apparatus 200. In the image forming apparatus 200, four image formation units Pa, Pb, Pc, and Pd that form toner images in each color component are arranged along a conveyance direction of an intermediate transfer belt 7. The image formation unit Pa forms a toner image in yellow, the image formation unit Pb forms a toner image in magenta, the image formation unit Pc forms a toner image in cyan, and the image formation unit Pd forms a toner image in black.

In the image forming apparatus 200, toner bottles Ta, Tb, Tc, and Td, which are detachable to the image forming apparatus 200, are attached. The toner bottle Ta contains yellow toner, the toner bottle Tb contains magenta toner, the toner bottle Tc contains cyan toner, and the toner bottle Td contains black toner. The toner bottles Ta, Tb, Tc, and Td serve as containers that contain toner.

The image formation units Pa, Pb, Pc, and Pd have a similar configuration. Thus, in the following, the image formation unit Pa that forms a yellow toner image will be described and the description related to the configuration of other image formation units Pb, Pc, and Pd will be omitted.

The image formation unit Pa includes a photosensitive drum 1*a* having a photosensitive layer which serves as a photosensitive member on a surface of a metal roller, a charger 2*a* that charges the photosensitive drum 1*a*, and a developer 100*a* in which a developing material (toner) is accumulated. The direction indicated by the arrow A is a direction that photosensitive drum 1*a* rotates. After the photosensitive drum 1*a* is charged by the charger 2*a*, a laser exposing device 3*a* exposes laser light to the photosensitive drum 1*a* based on yellow color component image data. With this configuration, an electrostatic latent image of the yellow color component is formed on the photosensitive drum 1*a*. The developer 100*a* develops the electrostatic latent image on the photosensitive drum 1*a* by using toner. With this configuration, a toner image is formed on the photosensitive drum 1*a*. Here, the developer 100*a* includes a toner density sensor 80*a* that detects an amount of a developing material (toner) in the developer 100*a*. In a case where the toner density sensor 80*a* detects that the amount of the toner in the developer 100*a* becomes low, toner is supplied from the toner bottle Ta to the developer 100*a*.

The image formation unit Pa includes a primary transfer roller 4*a* that transfers the toner image on the photosensitive drum 1*a* to the intermediate transfer belt 7. A primary transfer voltage is applied to the primary transfer roller 4*a* while the toner image formed on the photosensitive drum 1*a* is passing through a primary transfer nip section T1*a* where the photosensitive drum 1*a* and intermediate transfer belt 7 are pressed by the primary transfer roller 4*a*. With this configuration, the toner image on the photosensitive drum 1*a* is transferred to the intermediate transfer belt 7. The image formation unit Pa also includes a drum cleaner 6*a* that removes toner remained on the photosensitive drum 1*a*.

The intermediate transfer belt 7 is rotated by a secondary-transfer counter roller 8, a following roller 17, a first tension roller 18, and a second tension roller 19. The intermediate transfer belt 7 is rotated in the direction of the arrow B by a rotational drive of the secondary-transfer counter roller 8. In other words, the toner image on the intermediate transfer belt 7 is conveyed in the direction of the arrow B.

A secondary transfer roller 9 is provided in an opposite side of the secondary-transfer counter roller 8 as seen from the intermediate transfer belt 7. Since a secondary transfer voltage is applied to the secondary-transfer counter roller 8, the toner image on the intermediate transfer belt 7 is transferred to a recording medium S at a secondary transfer nip section T2 where the secondary-transfer counter roller 8 and intermediate transfer belt 7 are pressed by the secondary transfer roller 9. A belt cleaner 11 removes toner remained on the intermediate transfer belt 7.

The recording medium S to which the toner image is transferred is stored in a cassette unit 60. A sheet feed roller (not shown) feeds the recording medium S in the cassette unit 60. A conveyance roller 61 conveys the recording medium S fed by the sheet feed roller (not shown) toward a registration roller 62. After the recording medium S is conveyed to the registration roller 62, the registration roller 62 conveys the recording medium S so that the recording medium S contacts with the toner image on the intermediate transfer belt 7.

After the secondary transfer roller 9 transfers the toner image to the recording medium S, the recording medium S is conveyed to a fixing unit 13. The fixing unit 13 includes a fixing roller, which has a heater, and a pressing roller and fixes the toner image on the recording medium S onto the recording medium S by heat of the heater and pressure by the fixing roller and pressing roller. The recording medium S to which the toner image is fixed by the fixing unit 13 is discharged from the image forming apparatus 200 by the discharging roller 64.

Next, an image forming operation in which the image forming apparatus 200 prints a printed matter based on image data transferred from an unillustrated PC or scanner, and the like.

The photosensitive drums 1*a*, 1*b*, 1*c*, and 1*d* start a rotational drive in the direction of the arrow A. The chargers 2*a*, 2*b*, 2*c*, and 2*d* uniformly and electrostatically charge the photosensitive drum 1*a*, 1*b*, 1*c*, and 1*d*. Then, the laser exposing devices 3*a*, 3*b*, 3*c*, and 3*d* expose light to the photosensitive drums 1*a*, 1*b*, 1*c*, and 1*d* based on the image data. With this configuration, on the photosensitive drums 1*a*, 1*b*, 1*c*, and 1*d*, electrostatic latent images of each color components of the image data are formed. In this case, a sheet feed roller (not shown) feeds a recording medium S stored in the cassette unit 60, and the conveyance roller 61 starts to convey the recording medium S toward the registration roller 62.

Next, when the developers 100*a*, 100*b*, 100*c*, and 100*d* develop electrostatic latent images on the photosensitive drums 1*a*, 1*b*, 1*c*, and 1*d*, toner images in each color component are formed on the photosensitive drums 1*a*, 1*b*, 1*c*, and 1*d*. The toner images on the photosensitive drums 1*a*, 1*b*, 1*c*, and 1*d* are transferred to the primary transfer nip sections T1*a*, T1*b*, T1*c*, and T1*d*, according to the rotation of the photosensitive drums 1*a*, 1*b*, 1*c*, and 1*d* in the direction of the arrow A. In the primary transfer nip sections T1*a*, T1*b*, T1*c*, and T1*d*, the toner images of each color component on the photosensitive drums 1*a*, 1*b*, 1*c*, and 1*d* are transferred to the intermediate transfer belt 7. The primary transfer rollers 4*a*, 4*b*, 4*c*, and 4*d* transfer the toner images formed on the photosensitive drums 1*a*, 1*b*, 1*c*, and 1*d* to the intermediate transfer belt 7. With this configuration, a full-color toner image is formed on the intermediate transfer belt 7. Here, the toner remained on the photosensitive drums 1*a*, 1*b*, 1*c*, and 1*d* is removed by the drum cleaners 6*a*, 6*b*, 6*c*, and 6*d*.

The registration roller 62 adjusts timing to transfer the recording medium S to the secondary transfer nip section T2 so that the toner image on the intermediate transfer belt 7 is transferred to a desired position on the recording medium S. At the secondary transfer nip section T2, the secondary transfer roller 9 transfers the toner image on the intermediate transfer belt 7 to the recording medium S. Here, at the secondary transfer nip section T2, the toner, which is not transferred to the recording medium S and remained on the intermediate transfer belt 7, is removed by the belt cleaner 11.

The recording medium S that holds the toner image is conveyed to the fixing unit 13. With this configuration, the fixing unit 13 fuses and fixes the unfixed toner image on the recording medium S onto the recording medium S. Thus, the recording medium S which passes through the fixing unit 13 is discharged from the image forming apparatus 200 by the discharging roller 64. With the above image forming operation, the image forming apparatus 200 can print a printed matter based on the image data.

(Configuration of Control Unit)

Figure 2:
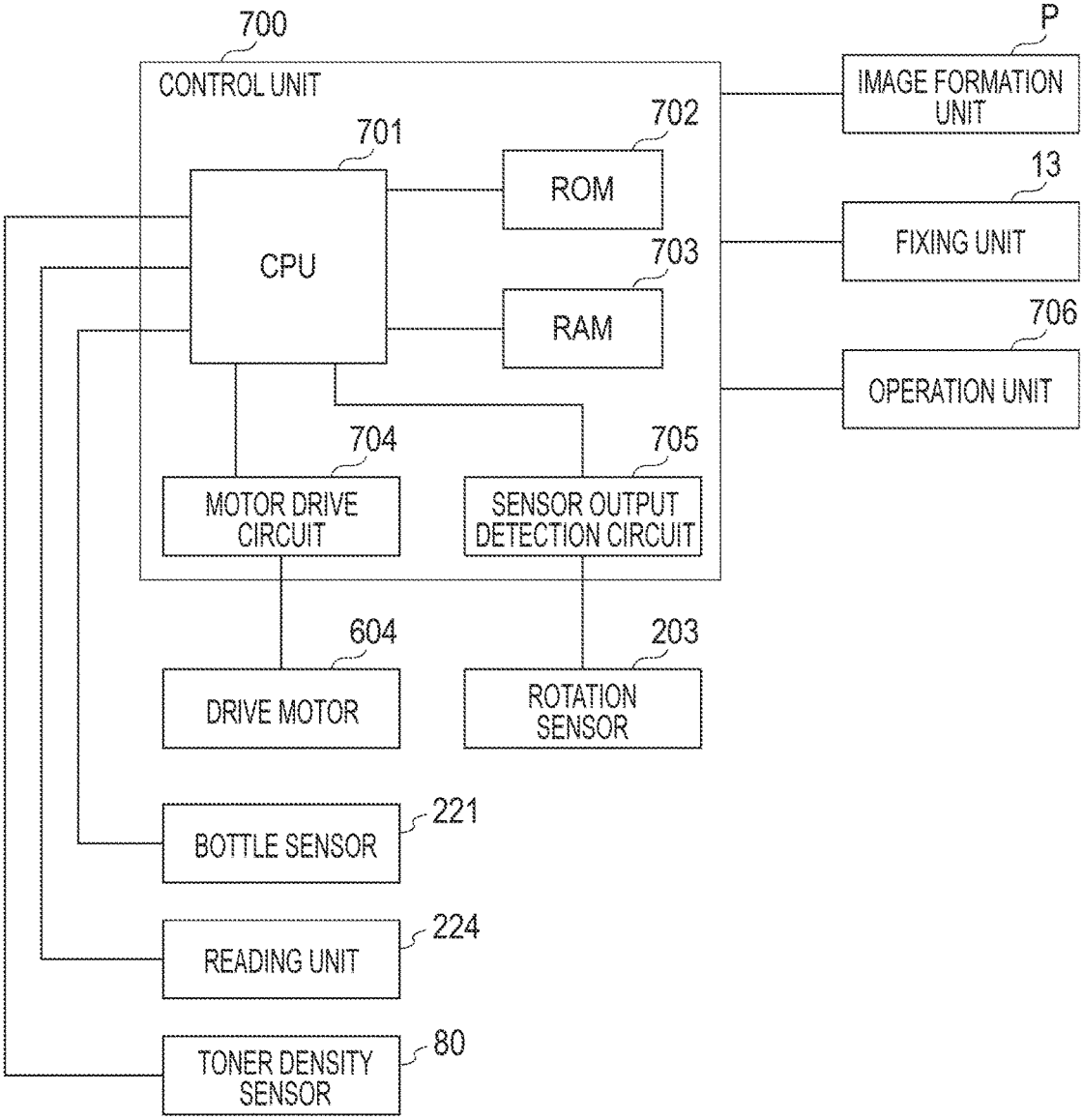
FIG. 2 is a control block diagram of the image forming apparatus.

FIG. 2 is a control block diagram of the image forming apparatus 200. In the following description, the toner bottles Ta, Tb, Tc, and Td are referred to as a toner bottle T and the developers 100*a*, 100*b*, 100*c*, and 100*d* are referred to as a developer 100. In the same manner, the image formation units Pa, Pb, Pc, and Pd are referred to as an image formation unit P, and the toner density sensors 80*a*, 80*b*, 80*c*, and 80*d* are referred to as a toner density sensor 80.

A control unit 700 controls the entire image forming apparatus 200. The control unit 700 includes a CPU 701, a ROM 702, a RAM 703, a motor drive circuit 704, and a sensor output detection circuit 705.

The CPU 701 is a control circuit that controls each device in the image forming apparatus 200. The ROM 702 stores control program for controlling various processes executed in the image forming apparatus 200. The RAM 703 is a system work memory used by the CPU 701 to execute the control programs. It is noted that the image formation unit P and fixing unit 13 have been described with reference to FIG. 1, the explanation will be omitted here.

A bottle sensor 221 detects whether the toner bottle T is attached to an attachment position of the image forming apparatus 200 and outputs the detection result to the CPU 701.

The toner density sensor 80 outputs a signal corresponding to a magnetic permeability that changes based on the amount of the toner in the developer 100, for example. Here, the toner density sensor 80 is not limited to a sensor that outputs a signal corresponding to the magnetic permeability that changes based on the amount of the toner in the developer 100 and may be any sensor as long as the sensor can detect the amount of the toner in the developer 100. The CPU 701 converts the output signal from the toner density sensor 80 into a toner density based on an unillustrated conversion table. The CPU 701 controls replenishment of toner from the toner bottle T to the developer 100 so that the toner density becomes a target density.

An operation unit 706 includes a touch panel. The operation unit 706 functions as a display having a touch panel (screen). The touch panel of the operation unit 706 displays a home screen, a replacement screen, a discharge failure screen, and a warning screen according to the signal from the CPU 701. Further, the touch panel notifies a user of a state of the image forming apparatus 200 according to the signal from the CPU 701. Here, the configuration for displaying the above screens is not limited to the touch panel and may be a monitor of a personal computer communicably connected to the image forming apparatus 200 via a network, for example.

A drive motor 604 is a drive source for rotating the toner bottle T to replenish toner from the toner bottle T to the developer 100. The motor drive circuit 704 controls an electric current supplied to the drive motor 604 to control the drive motor 604. The CPU 701 sets a PWM value, which is a control value that indicates a ratio of time to supply an electric current to the drive motor 604 within a predetermined period of time. With this configuration, the motor drive circuit 704 controls the electric current to be supplied to the drive motor 604 based on the PWM value. The drive motor 604 is a DC motor (DC brush motor). Thus, the rotation speed of the drive motor 604 and the rotational drive force of the drive motor 604 vary according to the ratio of time where the electric current is supplied to the drive motor 604 within the predetermined period of time.

Here, while the CPU 701 is outputting an ENB signal, the motor drive circuit 704 can supply an electric current to the drive motor 604. In other words, while the CPU 701 is outputting the ENB signal, the motor drive circuit 704 supplies an electric current to the drive motor 604 based on the PWM value. With this configuration, the toner bottle T is rotationally driven. On the other hand, when the CPU 701 stops the ENB signal, the supply of the electric current from the motor drive circuit 704 to the drive motor 604 stops. With this configuration, the rotation of the toner bottle T stops.

The rotation sensor 203 is an optical sensor including a light emitting unit and a light receiving unit and outputs a signal corresponding to a light quantity of the light receiving unit. While a predetermined area of the toner bottle T is passing through a detection position, the light quantity of the rotation sensor 203 reduces lower than a threshold value. On the other hand, in the rotation direction that the toner bottle T rotates, while an area, which is not the predetermined area, of the toner bottle T is passing through the detection position, the light quantity of the rotation sensor 203 becomes equal to or greater than the threshold value. Here, the detailed configuration of the rotation sensor 203 will be described with reference to FIGS. 4A to 4C.

Based on an output signal of the rotation sensor 203, the sensor output detection circuit 705 outputs a high-level signal when the light quantity of the rotation sensor 203 is equal to or greater than the threshold value and outputs a low-level signal when the light quantity of the rotation sensor 203 is lower than the threshold value. In other words, the sensor output detection circuit 705 outputs a low-level signal while the predetermined area of the toner bottle T is passing through the detection position, and outputs a high-level signal while an area, which is not the predetermined area, of the toner bottle T is passing through the detection position.

A reading unit 224 reads replenishment information registered in a memory 223 (FIGS. 4A to 4C) of the toner bottle T attached to the attachment position of the image forming apparatus 200 and notifies the replenishment information to the CPU 701. Further, the reading unit 224 may write the replenishment information notified from the CPU 701 to the memory 223 (FIGS. 4A to 4C) of the toner bottle T. The above described replenishment information includes a color of the toner bottle T, a serial number of the toner bottle T, and a replenishment history of the toner bottle T, for example. Here, the replenishment history of the toner bottle T is a number of rotations of the toner bottle T, for example. The CPU 701 controls the reading unit 224 to record the information of the number of rotations of the toner bottle T to the memory 223 (FIGS. 4A to 4C) every time the toner bottle T rotates one revolution. The number of rotations of the toner bottle T corresponds to the number of times to replenish the toner bottle.

The motor drive circuit 704, sensor output detection circuit 705, rotation sensor 203, bottle sensor 221, and reading unit 224 are provided for each color. Further, the drive motor 604 is also provided for each color. However, the drive motor 604 may have a configuration that a single drive motor rotates the plurality of toner bottles T, for example. In a case that there is the configuration that can control, with a clutch, between a condition that a drive force is transferred from the drive motor 604 to the toner bottle T and a condition that the drive force is not transferred, a single drive motor 604 can selectively rotate the plurality of toner bottles T.

(Description of Mounting Portion)

Figure 3A:
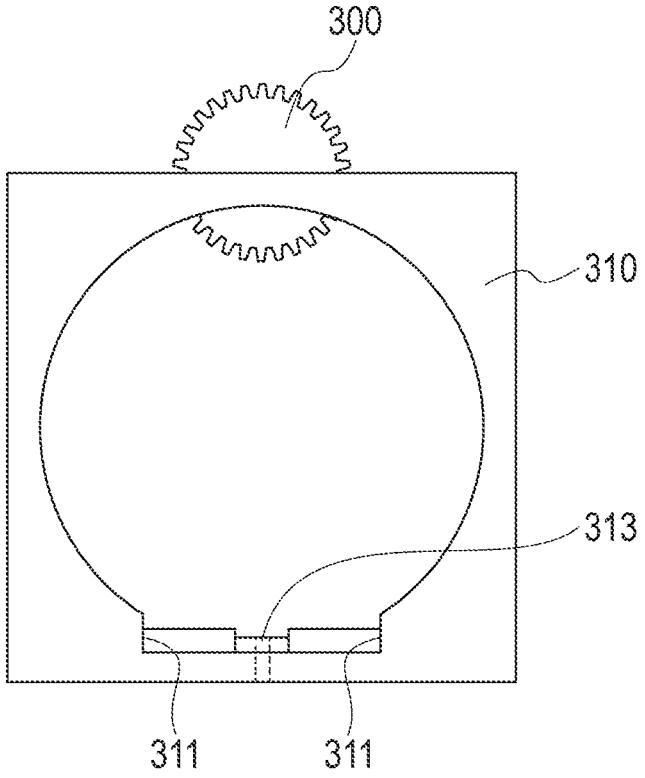
FIGS. 3A and 3B are schematic views of main parts of a mounting portion.
Figure 3B:
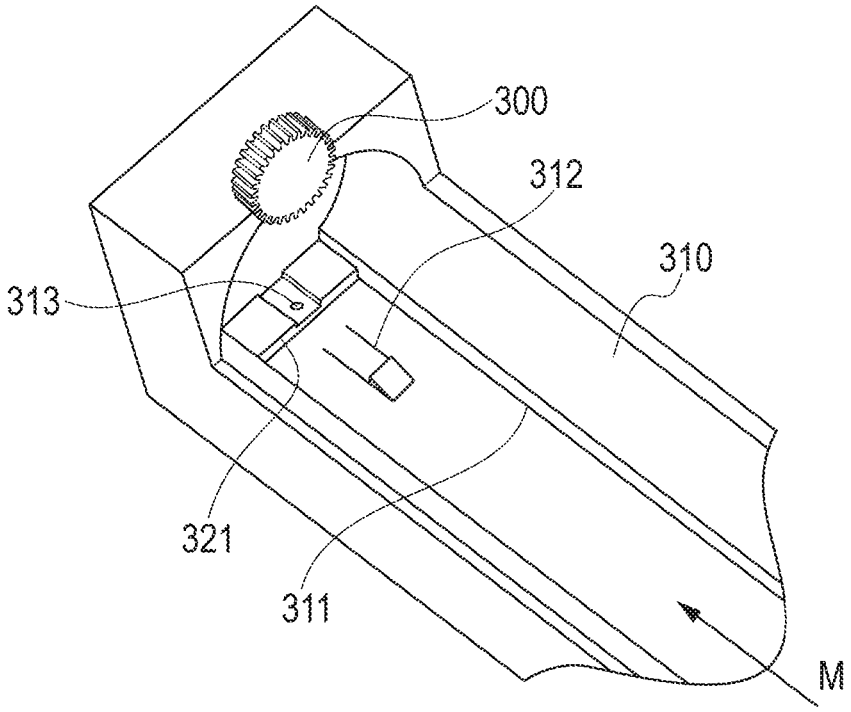

The toner bottle T is attached to a mounting portion 310 provided in the image forming apparatus 200. With reference to FIGS. 3A and 3B, a configuration of the mounting portion 310 will be described. FIG. 3A is a partial front view of the mounting portion 310, seen from the front in a direction of attaching the toner bottle T, and FIG. 3B is a perspective view for explaining the inside of the mounting portion 310. Here, as illustrated in FIG. 3B, the toner bottle T is attached to the mounting portion 310 in the direction of the arrow M. The direction of the arrow M is parallel to the rotational axis direction of the photosensitive drums 1*a*, 1*b*, 1*c*, and 1*d* of the image forming apparatus 200. Further, a direction to detach the toner bottle T from the mounting portion 310 is an opposite direction of the M direction.

The mounting portion 310 includes a rotation restriction portion 311 that restricts the rotation of a cap unit 222 (FIGS. 4A to 4C) of the toner bottle T according to the rotation of a drive gear 300 and toner bottle T, a bottom portion 321, and a restriction portion 312. The restriction portion 312 restricts the movement of the cap unit 222 (FIGS. 4A to 4C) in the rotational axis direction by latching the cap unit 222 (FIGS. 4A to 4C) of the toner bottle T.

The bottom portion 321 has a reception port (reception hole) 313 which communicates with a discharge port (discharge hole) 211 (FIGS. 4A to 4C) of the toner bottle T and receives toner discharged from the toner bottle T in a state where the toner bottle T is mounted. The toner discharged from the discharge port 211 (FIGS. 4A to 4C) of the toner bottle T is supplied to the developer 100 via the reception port 313. Here, a diameter of the reception port is same as that of the discharge port 211 (FIGS. 4A to 4C) and is about 2 [mm], for example.

The drive gear 300 transfers the rotational drive force from the drive motor 604 to the toner bottle T mounted in the mounting portion 310.

(Description of Toner Bottle)

Figure 4A:
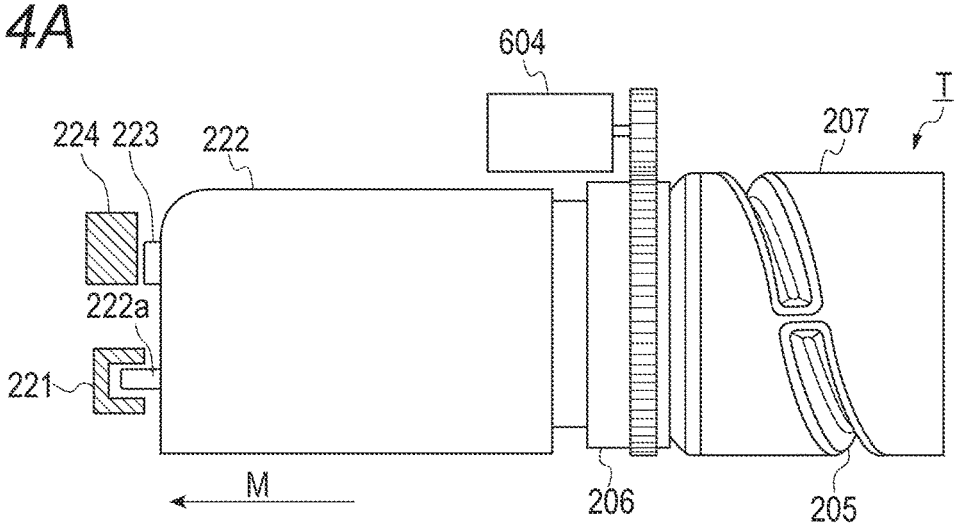
FIGS. 4A to 4C are schematic views of main parts of a toner bottle.
Figure 4B:
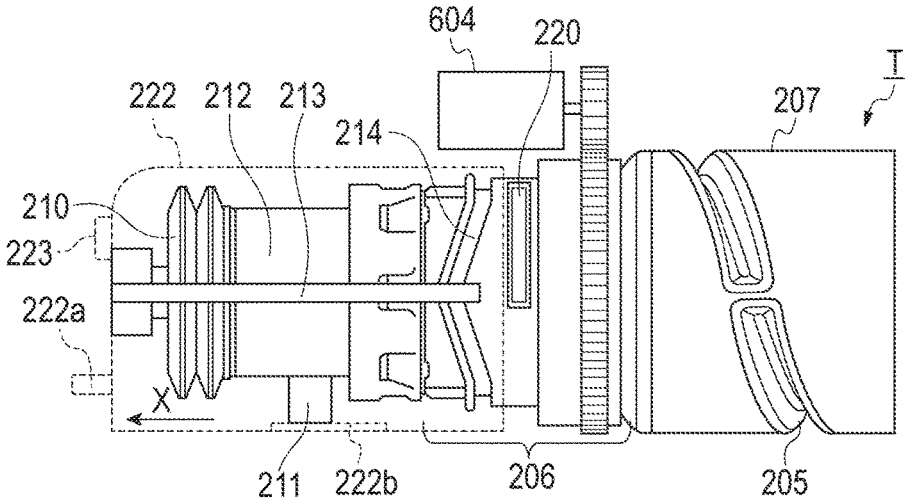
Figure 4C:
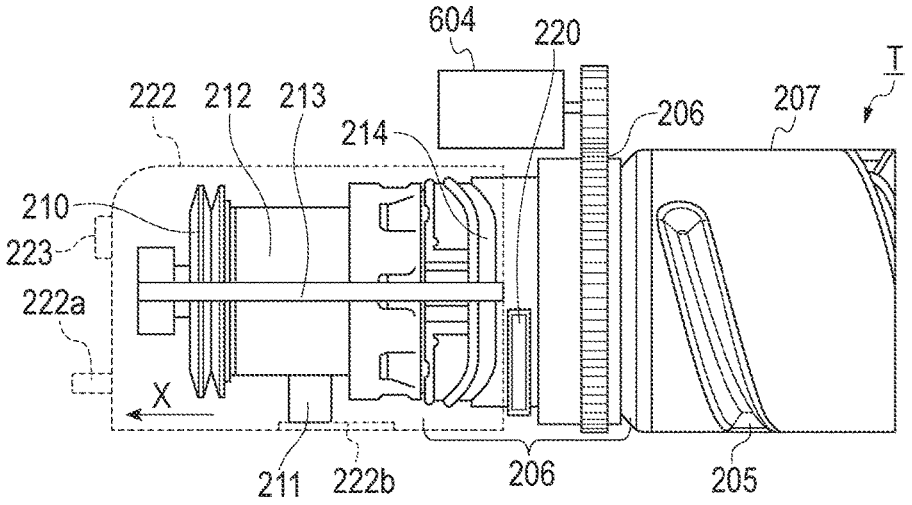

FIG. 4A is an outline view of the toner bottle T mounted to the mounting portion 310. FIGS. 4B and 4C are schematic diagrams illustrating a configuration in the cap unit 222 of the toner bottle T mounted to the mounting portion 310.

The toner bottle T includes a containing unit 207 that contains toner, a drive transmission unit 206 to which the rotational drive force is transmitted from the drive motor 604, a discharge unit 212 having a discharge port 211 that discharges toner, and a pump unit 210 for discharging toner in the discharge unit 212 via the discharge port 211. The toner bottle T further includes a reciprocation member 213 which makes the pump unit 210 expand and contract. The drive transmission unit 206 includes protruded portions 220 (predetermined portions) and a cam groove 214. The cam groove 214 is formed around the periphery of the drive transmission unit 206 in the rotation direction in which the drive transmission unit 206 of the toner bottle T rotates.

The cam groove 214 formed in the drive transmission unit 206 and the protruded portions 220 rotate integrally with the drive transmission unit 206. When the rotation driving force of the drive motor 604 is transmitted to the drive transmission unit 206 of the toner bottle T via the drive gear 300, the drive transmission unit 206 of the toner bottle T and the containing unit 207 coupled to the drive transmission unit 206 rotate. Spiral protruded portions 205 are formed inside the containing unit 207, and as the containing unit 207 rotates, the protruded portions 205 convey the toner in the containing unit 207 toward the discharge port 211.

On the other hand, since the rotation of the cap unit 222 is restricted by the mounting portion 310, the cap unit 222 therefore does not rotate even when the drive transmission unit 206 rotates. The rotation of the toner discharge port 211, the pump unit 210, and the reciprocation member 213 is also restricted along with the cap unit 222. Accordingly, the toner discharge port 211, the pump unit 210, and the reciprocation member 213 do not rotate even when the drive transmission unit 206 rotates.

Figure 5A:
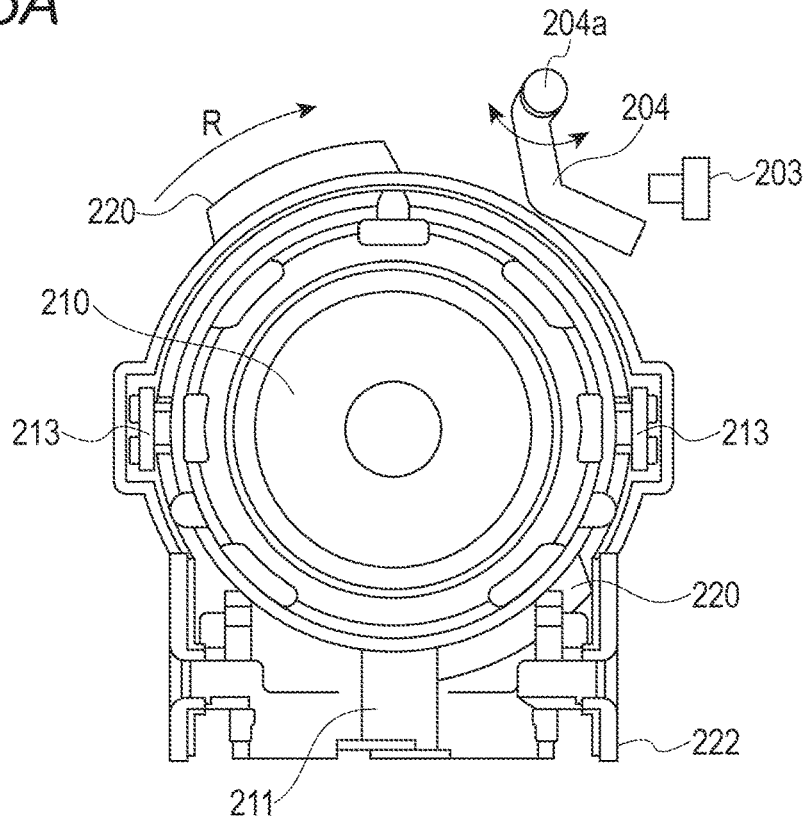
FIGS. 5A and 5B are schematic views of main parts of a flag sensor.
Figure 5B:
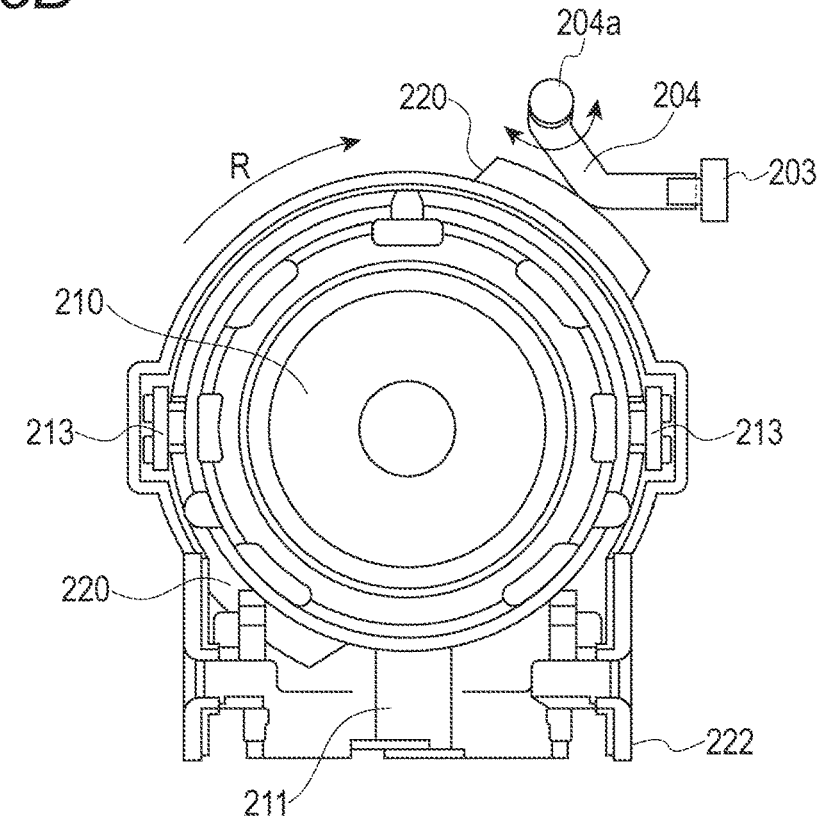

Rotation restriction grooves are formed inside the cap unit 222. The rotation restriction grooves are configured to restrict rotation of the reciprocation member 213 caused by rotation of the drive transmission unit 206. The reciprocation member 213 is engaged with the rotation restriction grooves (FIGS. 5A and 5B). The reciprocation member 213 is further connected to the pump unit 210 and includes not-illustrated tab portions which are engaged with the cam groove 214 of the drive transmission unit 206. When the drive transmission unit 206 rotates, the reciprocation member 213 moves along the cam groove 214 while the rotation of the reciprocation member 213 is restricted. As a result, the reciprocation member 213 reciprocates in the direction of the arrow X (the longitudinal direction of the toner bottle T).

The reciprocation member 213 is coupled to the pump unit 210. The reciprocation of the reciprocation member 213 makes the pump unit 210 repeat expansion and compression alternately. The reciprocation member 213 moves in the direction of the arrow X to expand the pump unit 210. The expansion of the pump unit 210 decreases the internal pressure of the toner bottle T, whereby air is sucked in from the discharge port 211 to loosen the toner in the discharge unit 212. The reciprocation member 213 then moves in the direction opposite to the direction of the arrow X to compress the pump unit 210. The compression of the pump unit 210 increases the internal pressure of the toner bottle T, whereby toner deposited in the discharge port 211 is supplied from the discharge port 211 to the developer 100 through a toner conveyance path. In other words, the drive motor 604 rotates the toner bottle T mounted to the mounting portion 310 and functions as a drive unit to expand and compress the pump unit 210 corresponding to the rotational drive of the toner bottle T.

The cap unit 222 has a projection 222*a* on the top side of the toner bottle T in the mounting direction (the direction of the arrow M). The bottle sensor 221 provided in the image forming apparatus 200 detects that the toner bottle T is mounted to the mounting portion 310 (FIGS. 3A and 3B). In a state where the toner bottle T is mounted in the mounting position, the bottle sensor 221 detects the projection 222*a* of the cap unit 222. The bottle sensor 221 then outputs, to the CPU 701 (FIG. 2), a signal indicating that the toner bottle T is mounted.

Further, to the cap unit 222, the memory 223 which records information related to the toner bottle T, is attached. The CPU 701 (FIG. 2) controls the reading unit 224 to communicate with the memory 223 and reads the replenishment information of the toner bottle T. Further, the CPU 701 (FIG. 2) controls the reading unit 224 to write, to the memory 223, information of the number of rotations of the toner bottle T every time the toner bottle T rotate one revolution.

Further, the cap unit 222 includes a seal member 222*b* that seals the discharge port 211. When the discharge port 211 is sealed by the seal member 222*b*, this prevents the toner in the toner bottle T from leaking through the discharge port 211. Here, when the user removes the seal member 222*b* before the toner bottle T is mounted to the mounting portion 310 (FIGS. 3A and 3B), the discharge port 211 of the toner bottle T is released.

Here, FIG. 4B is a sectional view illustrating essential parts of the toner bottle T when the pump unit 210 of the toner bottle T is fully expanded. FIG. 4C is a sectional view illustrating the essential parts of the toner bottle T when the pump unit 210 of the toner bottle T is fully compressed. The pump unit 210 is an accordion-like pump made of resin. The volumetric capacity of the pump unit 210 changes according to the expansion and compression of the pump unit 210. The "ridge" folds and "valley" folds of the pump unit 210 are alternately arranged in the longitudinal direction of the toner bottle T.

The image forming apparatus 200 performs replenishing operation twice while the toner bottle T rotates one revolution. One toner replenishing operation starts in a condition that the pump unit 210 is fully compressed, expands the pump unit 210, then compresses the pump unit 210, and ends the operation in a condition that the pump unit 210 is fully compressed.

The cam groove 214 has two peaks and two valley areas, which are formed in the order of a valley, peak, valley, and peak. While the position of the cam groove 214 engaged with the reciprocation member 213 changes from the valley to the peak, the pump unit 210 is fully expanded. While the position of the cam groove 214 engaged with the reciprocation member 213 changes from the peak to the valley, the pump unit 210 is fully compressed. In a state where the position of the cam groove 214 engaged with the reciprocation member 213 is at the valley, the pump unit 210 is maintained to be fully compressed.

(Configuration of Rotation Sensor)

Next, the rotation sensor 203 provided in the image forming apparatus 200 will be described with reference to FIGS. 5A and 5B. The rotation sensor 203 is an optical sensor including a light emitting unit and a light receiving unit that receives light emitted from the light emitting unit. A flag 204 makes contact with the drive transmission unit 206 of the toner bottle T by its own weight. Thus, the flag 204 is pushed by the protruded portion 220 of the drive transmission unit 206, swings about a rotation shaft 204*a*, and blocks the light from the light emitting unit. In other words, the rotation sensor 203 can detect whether the flag 204 is contacting with the protruded portion 220. With this configuration, the rotation sensor 203 can detect a rotation position of the toner bottle T.

FIG. 5A illustrates a state where the flag 204 is in contact with a position overlapping with the areas where the protruded portions 220 are formed in the mounting direction of the toner bottle T and an area (another area) different from the protruded portions 220 in the rotation direction of the drive transmission unit 206. In this case, since the flag 204 is not placed between the light emitting unit and the light receiving unit, the light receiving unit can receive the light emitted from the light emitting unit. In the image forming apparatus 200, in a case where the flag 204 is not placed between the light emitting unit and light receiving unit, the light amount received by the light receiving unit becomes equal to or greater than a threshold value. Here, the sensor output detection circuit 705 (FIG. 2) outputs a high-level signal (logical 'H') when the light amount received by the light receiving unit is equal to greater than the threshold value, and outputs a low-level signal (logical 'L') when the light amount received by the light receiving unit is less than the threshold value. In other words, in a state where the flag 204 is contacting with an area which is not the protruded portion 220, the sensor output detection circuit 705 (FIG. 2) outputs a high-level signal (logical 'H') to the CPU 701 (FIG. 2).

On the other hand, FIG. 5B illustrates a state that the flag 204 is contacting with the protruded portion 220. In this case, since the flag 204 is placed between the light emitting unit and light receiving unit, the light receiving unit cannot receive the light emitted from the light emitting unit. In other words, the light amount received by the light receiving unit is less than the threshold value. In other words, in a case where the flag 204 is contacting with the protruded portion 220, the sensor output detection circuit 705 (FIG. 2) outputs a low-level signal (logical 'L') to the CPU 701 (FIG. 2).

Here, In the toner bottle T, the pump unit 210 starts to expand after the output signals from the sensor output detection circuit 705 (FIG. 2) changes from a low level to a high level. While the output signals from the sensor output detection circuit 705 (FIG. 2) are kept in the high level, the pump unit 210 is fully expanded and then starts to be compressed. Then, before the output signals from the sensor output detection circuit 705 (FIG. 2) changes from the high level to the low level, the pump unit 210 becomes fully compressed.

It has been found, by an experiment, that an amount of toner replenished from the toner bottle T to the developer 100 (replenishing amount) becomes a value corresponding to the speed of a change in an internal pressure in the toner bottle T. Further, it is also known that the rotation speed of the toner bottle T becomes faster as the weight of the toner bottle T reduces. Thus, in the image forming apparatus 200, the position of the start status is designed so that the DC motor becomes stable in a target rotation speed before the pump unit 210 starts to expand. In other words, a position of an end state of a previous toner replenishment is set.

Further, the CPU 201 (FIG. 2) performs a feedback control of the rotation speed of the toner bottle T to lower the change of the rotation speed of the toner bottle T corresponding to the change in the weight of the toner bottle T. To perform a highly accurate feedback control, it is important to highly accurately measure the rotation speed of the toner bottle T. The DC motor (DC brush motor) has a characteristic that it takes time to rise to the target rotation speed and to stop. Thus, a timing is to be detected that the DC motor (DC brush motor) is stable at a target rotation speed and measure the rotation speed.

The image forming apparatus 200 is designed so that the DC motor (DC brush motor) is stabilized at the target rotation speed before the pump unit 210 starts to expand. Thus, the rotation speed of the toner bottle T in the period between an expansion of the pump unit 210 to a compression of the pump unit 210 is measured.

Further, the width of the valley area of the cam groove 214 is made wider than the width of the peak area of the cam groove 214 so that the rotation of the toner bottle T stops when the pump unit 210 is fully compressed. This configuration lowers a possibility that the rotation of the toner bottle T is stopped when the pump unit 210 is not fully compressed.

(Sequence of Out-of-Toner Detection)

Figure 6:
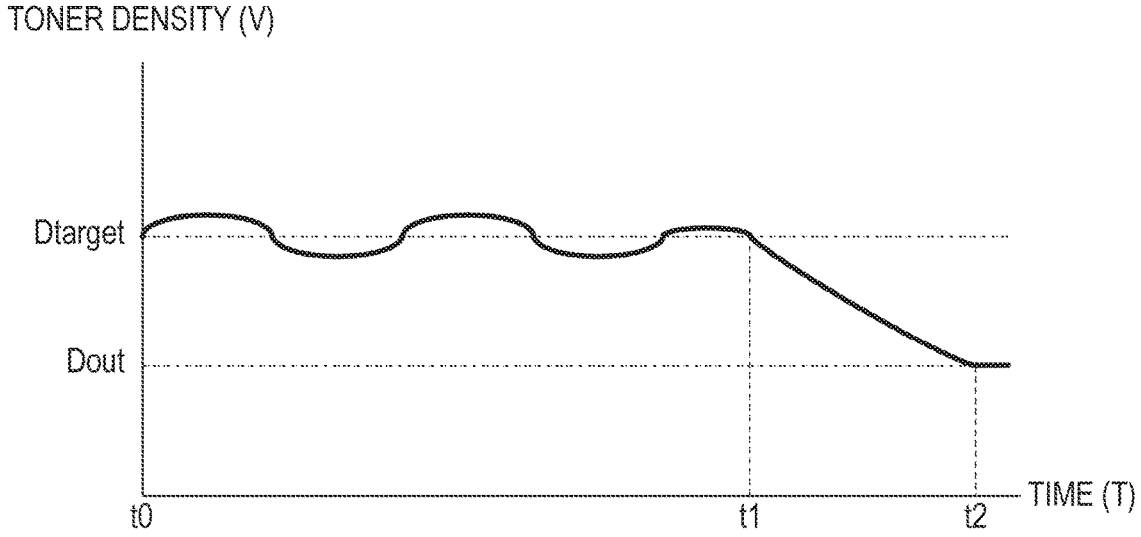
FIG. 6 is a diagram illustrating a transition of a toner density in a developer.

In the following, an out-of-toner detection sequence will be described. FIG. 6 is a schematic view illustrating a transition of the toner density in the developer 100. The CPU 701 (FIG. 2) controls toner replenishment from the toner bottle T to the developer 100 so that the toner density detected by the toner density sensor 80 becomes a target toner density Dtarget. Here, the CPU 701 (FIG. 2) obtains an output value of the toner density sensor 80 every 10 msec.

When a state that the toner density D detected by the toner density sensor 80 is lower than the target toner density Dtarget is maintained for 500 msec, the CPU 701 (FIG. 2) controls the drive motor 604 to rotate the toner bottle T. With this configuration, since the toner is replenished from the toner bottle T to the developer 100, the toner density D detected by the toner density sensor 80 increases. In other words, the CPU 701 serves as a controller for controlling the drive motor 604 so that the amount of the developing material in the developer 100 becomes a target amount.

The toner amount in the developer 100 lowers during an image formation. Thus, the CPU 701 (FIG. 2) replenishes toner from the toner bottle T to the developer 100 every time the state that the toner density D is less than the target toner density Dtarget is maintained for 500 msec. As illustrated in a period from time t0 to time t1 in FIG. 6, the toner density D in the developer 100 is controlled to be the target toner density Dtarget.

Further, when the toner amount in the toner bottle T becomes lower than Z1, the toner amount replenished from the toner bottle T to the developer 100 is remarkably lowered. Then, when the toner amount in the toner bottle T becomes lower than Z2, the toner is not replenished to the developer 100 even when the toner bottle T rotates. Thus, when the toner amount in the toner bottle T is lower than a predetermined amount (Z2), the toner amount in the developer 100 keeps lowering while the image forming apparatus 200 is performing an image forming operation. When the toner amount in the toner bottle T becomes lower than Z2, as illustrated in the period from time t1 to time t2 in FIG. 6, the toner density D in the developer 100 keep lowering. Then, at time t2 in FIG. 6, the toner density D becomes less than the threshold value Dout. Here, the toner amount Z2 is lower than the toner amount Z1.

The CPU 701 (FIG. 2) stops the image forming operation when the toner density D detected by the toner density sensor 80 becomes lower than the threshold value Dout. Then, the CPU 701 (FIG. 2) controls the drive motor 604 (FIG. 2) to perform an ejecting process. The ejecting process is a process for controlling the drive of the drive motor 604 (FIG. 2) so that the replenishing amount from the toner bottle T to the developer 100 becomes greater than the replenishing amount in a normal replenishing operation. When the ejecting process is performed, for example, the CPU 701 (FIG. 2) repeats an operation five times to rotate the toner bottle T four revolutions and then stops the rotation for two seconds. The ejecting process corresponds to a predetermined replenishing operation.

When the toner amount in the toner bottle T is equal to or greater than the predetermined amount (Z2), the toner density D in the developer 100 is supposed to be increased while an ejecting process is performed. The CPU 701 (FIG. 2) determines that the toner amount in the toner bottle T is lower than the predetermined amount (Z2) when the toner density D does not reach the target toner density Dtarget even if the ejecting process is performed.

Figure 7:
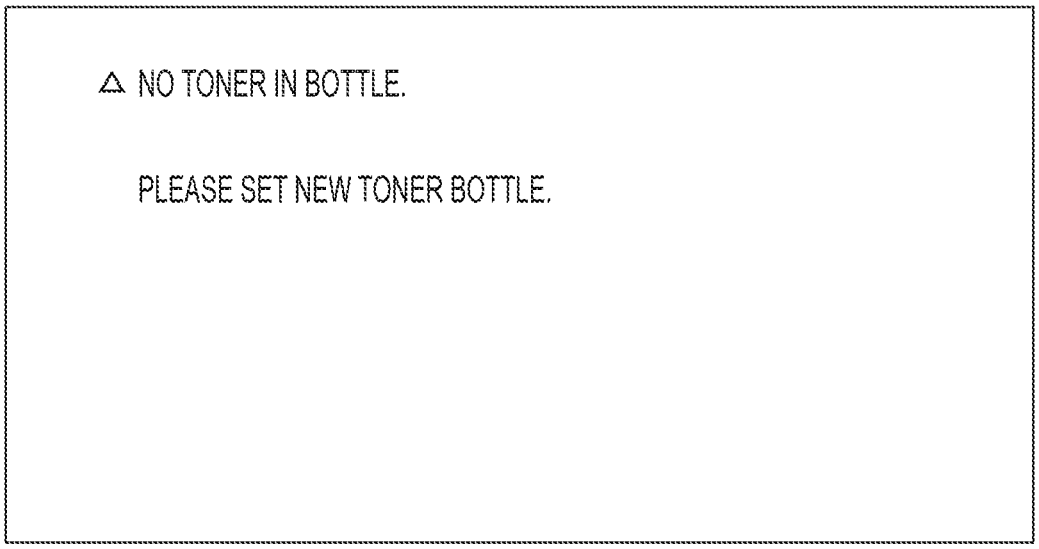
FIG. 7 is a schematic view of a replacement screen.

FIG. 7 is a schematic view of a replacement screen displayed on the touch panel of the operation unit 706 after it is determined that the toner amount in the toner bottle T is lower than the predetermined amount (Z2). The replacement screen is a screen to notify a user that there is out of toner in the toner bottle T and the toner bottle T is to be replaced with a new toner bottle T. The replacement screen corresponds to a first guidance to prompt the user to replace the toner bottle T mounted in the mounting portion 310.

According to the instruction on the replacement screen, the user takes out the toner bottle T from the mounting portion 310 and attaches a new toner bottle T to the mounting portion 310. When the bottle sensor 221 (FIG. 2) detects that the toner bottle T is detached and then the bottle sensor 221 (FIG. 2) detects that the toner bottle T is attached, the CPU 701 (FIG. 2) clears the display of the replacement screen. In a case where the toner bottle T is replaced, a home screen is displayed on the touch panel of the operation unit 706.

The home screen is a screen, which is different from the replacement screen, a discharge failure screen, and a warning screen. The home screen is a screen that the user changes print settings of the image forming apparatus 200, for example. On the home screen, the user can set the number of copies, a print density, and a print mode, for example.

Here, since the toner density D in the developer 100 is lower than the target toner density Dtarget immediately after the toner bottle T is replaced, the CPU 701 (FIG. 2) controls the drive motor 604 (FIG. 2) to perform the toner replenishing. Then, after the toner density D in the developer 100 becomes greater than the target toner density Dtarget, the image forming apparatus 200 can execute the image forming operation.

(Detachment Warning Sequence)

In a case where the toner bottle T is detached before it is determined that the toner amount in the toner bottle T is lower than the predetermined amount (Z2) in the above described out-of-toner detection sequence, the user is likely to replace the toner bottle T, which is not basically needed to be replaced. Thus, in a case where the bottle sensor 221 detects that the toner bottle T is detached in a condition that it is not determined that the toner amount in the toner bottle T is lower than the predetermined amount (Z2), the warning screen illustrated in FIG. 8 is displayed on the touch panel of the operation unit 706 (FIG. 2).

The warning screen displays information related to a color of the toner in the detached toner bottle T, and a message to prompt the user to reattach the detached toner bottle T to the mounting portion 310. With this configuration, it is prevented that the user mistakenly replaces the toner bottle T, which is not needed to be replaced. The warning screen corresponds to a second guidance for encouraging the user to reattach the detached toner bottle T.

The display of the warning screen is cleared after the user reattaches the toner bottle T to the mounting portion 310. In this case, the above described home screen is displayed on the touch panel of the operation unit 706. In other words, in a case where the bottle sensor 221 detects that the toner bottle T is attached while the warning screen is being displayed, the home screen is displayed on the touch panel of the operation unit 706.

(Discharge Failure Notification Sequence)

When the toner bottle T is left as having the cap unit 222 facing downward in the direction of gravitational force for a long period of time, the toner bottle T may not properly replenish the toner. This is because the toner in the toner bottle T is agglutinated at the discharge unit 212 and the toner is not discharged from the discharge port 211, in a case where the toner bottle T is kept as having the cap unit 222 facing downward in the direction of gravitational force for a long period of time. In the following description, an abnormal condition that the toner is not discharged from the toner bottle T even when the drive motor 604 rotates the toner bottle T is referred to as a discharge failure. Here, it has been known that the discharge failure occurs in a toner bottle T which is newly attached to the mounting portion 310.

Figure 9:
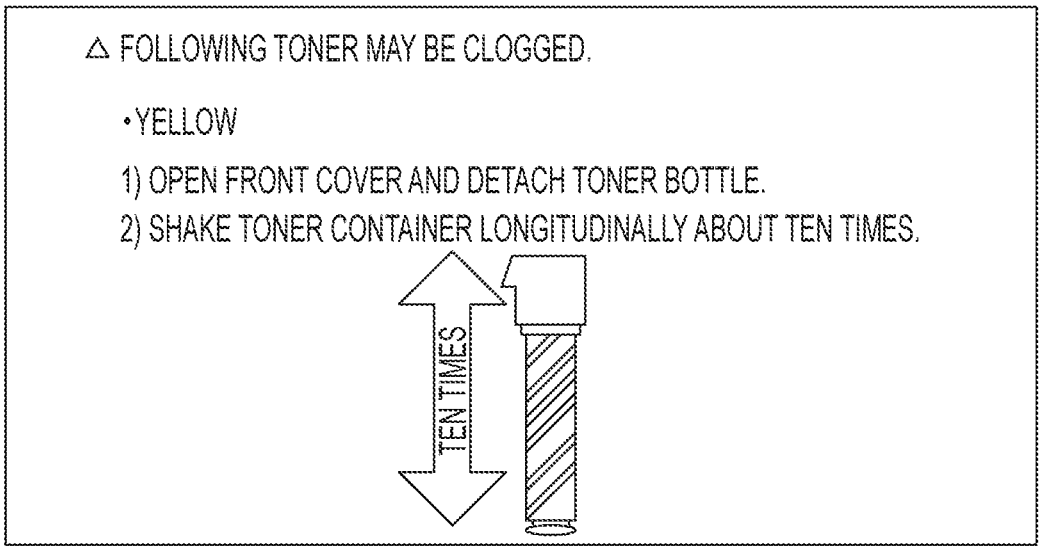
FIG. 9 is a schematic view of a discharge failure screen.

To loosen the toner agglutinated at the discharge port 211, the toner bottle T may be shaken as having the cap unit 222 facing upward in the direction of gravitational force. Thus, in a case where the discharge failure occurs in the toner bottle T, the discharge failure screen illustrated in FIG. 9 is displayed on the touch panel of the operation unit 706.

The discharge failure screen shows information related to the color of the toner in the toner bottle T in which the discharge failure is detected, and a screen to prompt the user to operate to solve the discharge failure. According to the instruction on the discharge failure screen, the user can perform the operation to solve the discharge failure. The discharge failure screen corresponds to a third guidance to prompt the user to perform a solving operation to solve the discharge failure of the toner bottle T, which is attached to the mounting portion 310.

The image forming apparatus 200 determines that a discharge failure has occurred in the toner bottle T in a case where the toner density in the developer 100 does not increase even when the drive motor 604 rotates the toner bottle T and the number of replenishment of the toner bottle T is less than a predetermined period of time. The number of replenishment of the toner bottle T is the number of the replenishments stored in the memory 223. The predetermined number of times is, for example, 100 times. Here, in a case where a discharge failure has not occurred in the toner bottle T, the replenishing amount of 100 toner replenishments is sufficiently greater than a toner amount corresponding to a gap between the threshold value Dout and target toner density Dtarget.

(Usability)

With reference to a comparative example illustrated in FIG. 10A and the present embodiment illustrated in FIG. 10B, a screen transition on the touch panel of the operation unit 706 after a discharge failure occurs in the toner bottle T will be described.

Figure 10A:
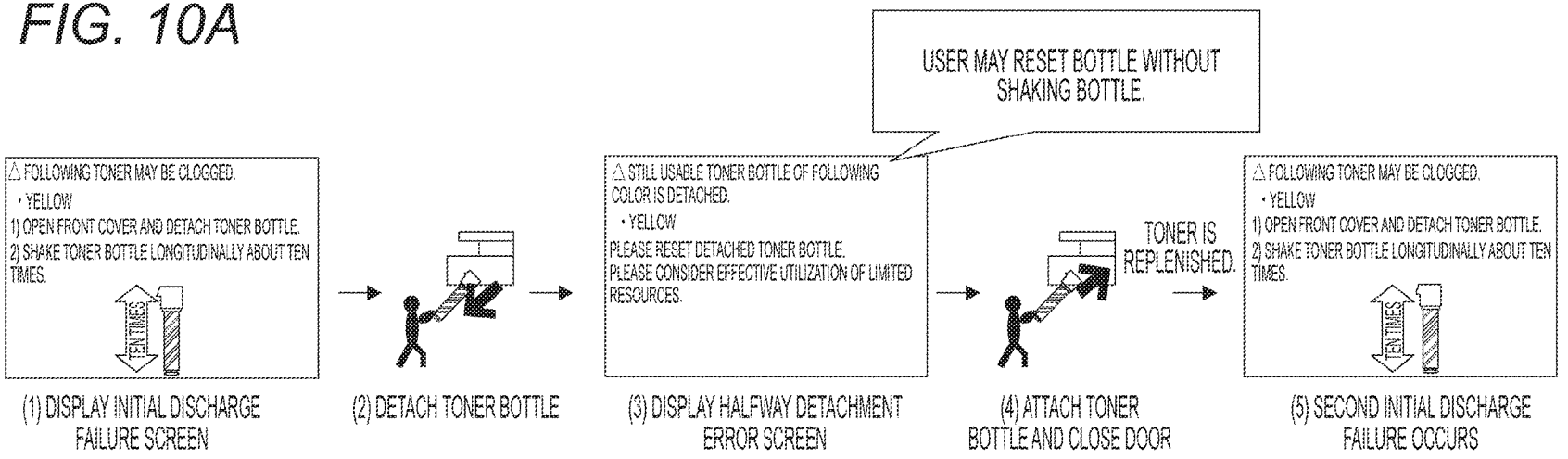
FIGS. 10A and 10B are schematic views illustrating screen transitions of an operation unit.

The image forming apparatus of the comparative example illustrated in FIG. 10A does not determine that a toner amount in a toner bottle T is lower than a predetermined amount when a discharge failure occurs. Thus, the image forming apparatus of the comparative example illustrated in FIG. 10A displays a warning screen after the toner bottle T is detached. In this case, after the toner bottle T is detached, the user cannot determine whether it is needed to perform an operation to solve a discharge failure. In the comparative example illustrated in FIG. 10A, the user may reattach the toner bottle T to the mounting portion 310 without doing an operation to solve a discharge failure. Since the discharge failure has not solved in the reattached toner bottle T, the toner is not replenished from the toner bottle T to the developer 100.

Figure 10B:
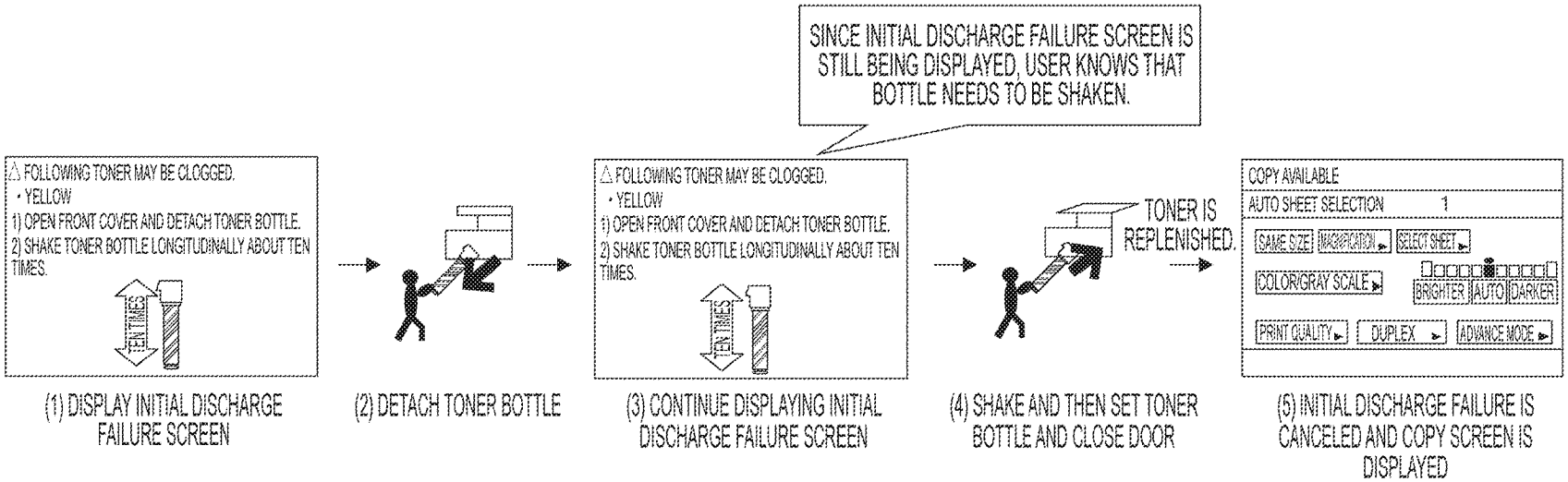

On the other hand, according to the present embodiment illustrated in FIG. 10B, the discharge failure screen is kept being displayed even after the toner bottle T is detached. This helps the user to recognize that an operation to solve the discharge failure may be needed. In other words, since the discharge failure screen is kept being displayed even after the toner bottle T is detached, the present embodiment illustrated in FIG. 10B is to be used. With this configuration, according to the present embodiment illustrated in FIG. 10B, the user reattaches the toner bottle T to the mounting portion 310 after performing an operation to solve the discharge failure. According to the present embodiment illustrated in FIG. 10B, since the toner is replenished from the reattached toner bottle T to the developer 100, downtime that the image forming operation cannot be executed is suppressed.

(Replenishing Control)

Figure 11:
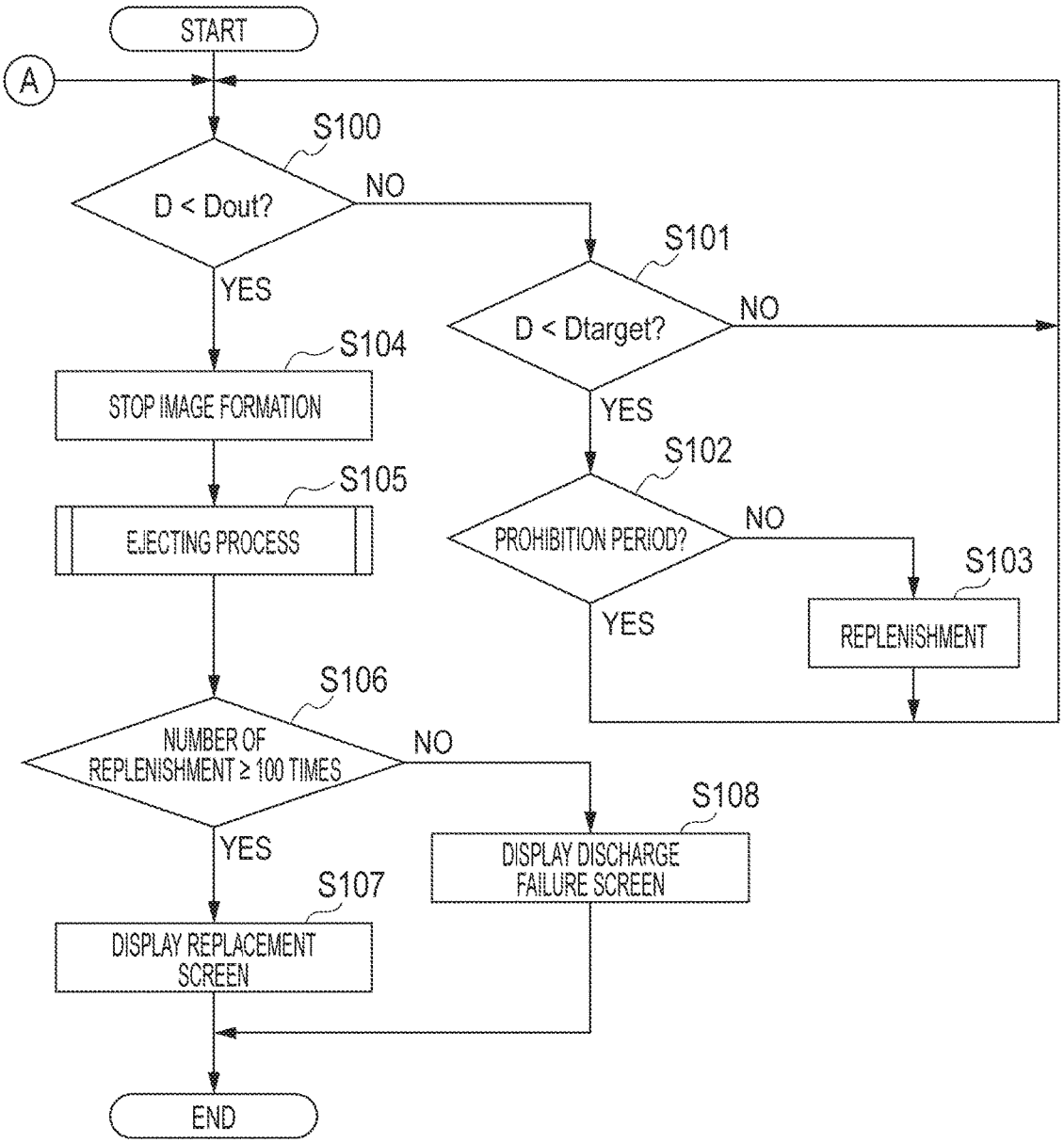
FIG. 11 is a flowchart illustrating a replenishing control.

Next, a replenishing control that the image forming apparatus 200 controls to replenish toner from the toner bottle T to the developer 100 will be described based on the control block diagram in FIG. 2 and a flowchart in FIG. 11. Here, the replenishing control illustrated in FIG. 11 is executed by that the CPU 701 illustrated in FIG. 2 reads the program stored in the ROM 702.

Further, after a main power source of the image forming apparatus 200 is turned on, the CPU 701 obtains replenishment information of the toner bottle T by using the reading unit 224. Then, the CPU 701 stores the replenishment information in the RAM 703. After an initial adjustment control is performed, the CPU 701 starts the replenishing control process illustrated in FIG. 11.

In step S100, the CPU 701 determines whether the toner density D in the developer 100 is lower than the threshold value Dout based on the detection result by the toner density sensor 80. When the toner density D is equal to or greater than the threshold value Dout in step S101, the CPU 701 proceeds the process to step S101. In step S101, the CPU 701 determines whether the toner density D is lower than the target toner density Dtarget. When the toner density D is equal to or greater than the target toner density Dtarget in step S101, the CPU 701 proceeds the process to step S100. In other words, when the toner density D is equal to or greater than the target toner density Dtarget, the CPU 701 does not perform the toner replenishing.

On the other hand, when the toner density D is lower than the target toner density Dtarget in step S101, the CPU 701 proceeds the process to step S102. In step S102, the CPU 701 determines whether the time passed since a previous toner replenishment is executed has become equal to or longer than a prohibition time. Here, in the image forming apparatus 200, there is a time lag between a timing that the toner is replenished from the toner bottle T to the developer 100 and a timing that a change occurs in the toner density in the developer 100. Thus, the CPU 701 does not perform a toner replenishment again during the prohibition time (prohibition period) after one toner replenishment from the toner bottle T to the developer 100. This suppresses that the toner is excessively replenished from the toner bottle T to the developer 100. The prohibition time is set to 1 sec, for example. The CPU 701 measures, with an unillustrated timer, the time since the previous toner replenishment is executed. When the elapsed time is shorter than the prohibition time in step S102, the CPU 701 does not perform the toner replenishing and proceeds the process to step S100.

On the other hand, when the elapsed time is equal to or longer than the prohibition time in step S102, the CPU 701 proceeds the process to step S103. In step S103, the CPU 701 drives the drive motor 604 to rotate the toner bottle T. In this case, the CPU 701 sets a PWM value stored in the RAM 703 to the motor drive circuit 704 and outputs an ENB signal to the motor drive circuit 704. Here, when the PWM value is not stored in the RAM 703, the CPU 701 sets a predetermined value as the PWM value, for example.

In the following, a rotation speed control by the drive motor 604 will be described. After the drive motor 604 starts to rotate, the CPU 701 starts to measure the time in response to that the output signal from the sensor output detection circuit 705 changes from the low level to the high level. Then, the CPU 701 stops measuring the time when the output signal from the sensor output detection circuit 705 changes from the high level to the low level and stops the ENB signal which has been input to the motor drive circuit 704. Accordingly, the drive motor 604 stops and the rotation of the toner bottle T stops.

It is assumed that the period of time when the sensor output detection circuit 705 is outputting high-level signals is measured time Tn. In other words, the measured time Tn is a value obtained by measuring the time from a release of pushing up the flag 204 by a trailing edge of the protruded portion 220 in a rotation direction that the toner bottle T rotates to a push up of the flag 204 by a leading edge of the protruded portion 220 in the rotation direction. The length of the area other than the protruded portion 220 is determined in advance. Thus, the CPU 701 calculates a rotation speed V(n) of the toner bottle T based on the measured time Tn and a length of the area other than the protruded portion 220.

Then, the CPU 701 corrects the PWM value stored in the RAM 703 based on the equation (1).

$$D(n+1)=D(n)+Ki\times(Vtgt-V(n)) \quad (1)$$

Here, D(n) is a current PWM value stored in the RAM 703, D(n+1) is a correction value of the PWM value, Ki is a proportionality factor, and Vtgt is a target rotation speed. The correction value D(n+1) of the PWM value is used in a following replenishing operation.

Description returns to the replenishing control of FIG. 11. When the toner density D is lower than the threshold value Dout in step S100, the CPU 701 proceeds the process to step S104. In step S104, the CPU 701 controls the image formation units P to stop the execution of the image forming operation. Here, the image forming apparatus 200 includes four image formation units P. Thus, when the toner density of any one of the developers 100 is lower than the threshold value, the execution of the image forming operation is stopped.

After the image forming operation is stopped, the CPU 701 proceeds the process to step S105. In step S105, the CPU 701 executes the ejecting process. In other words, in a case where the toner density D in the developer 100 becomes lower than the threshold value Dout, the CPU 701 controls the image formation unit P to stop the image forming operation and executes the ejecting process. Then, the CPU 701 proceeds the process to step S106. In step S106, the CPU 701 determines whether the number of replenishments of the toner bottle T stored in the RAM 703 is equal to or greater than a predetermined number. Here, the predetermined number is 100 times.

When the number of replenishments is equal to or greater than 100 times in step S106, the CPU 701 determines that the toner amount in the toner bottle T is lower than the predetermined amount (Z2) and proceeds the process to step S107. This is because that a discharge failure does not suddenly occur in the toner bottle T, which has properly performed a toner replenishment. In other words, it is because that a discharge failure likely occurs in an unused toner bottle T. In step S107, the CPU 701 displays a replacement screen on the operation unit 706. Then, the CPU 701 ends the replenishing control as displaying the replacement screen on the operation unit 706.

On the other hand, when the number of replenishments is less than 100 times in step S106, the CPU 701 determines that a discharge failure has occurred in the toner bottle T and proceeds the process to step S108. In step S108, the CPU 701 controls the operation unit 706 to display a discharge failure screen. Then the CPU 701 ends the replenishing control as displaying the discharge failure screen on the operation unit 706.

Figure 12:
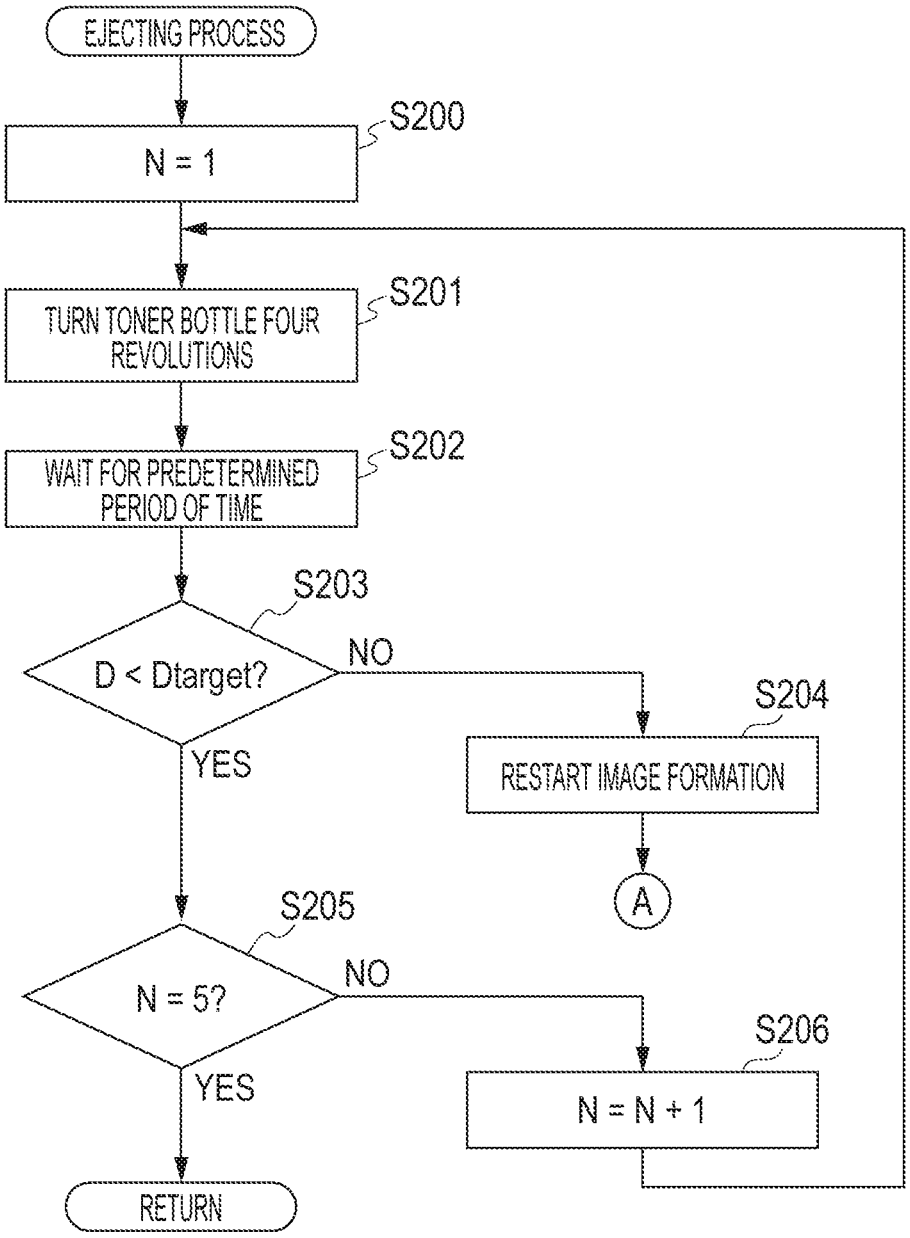
FIG. 12 is a flowchart illustrating an ejecting process.

Next, the ejecting process illustrated in step S105 of FIG. 11 will be described based on the control block diagram in FIG. 2 and a flowchart of FIG. 12. Here, the ejecting process illustrated in FIG. 12 is executed by that the CPU 701 illustrated in FIG. 2 reads the program stored in the ROM 702.

When the ejecting process starts, in step S200, the CPU 701 sets a count value N to 1. Then, the CPU 701 proceeds the process to step S201 and rotates the toner bottle T four revolutions. In step S201, the CPU 701 sets the PWM value stored in the RAM 703 to the motor drive circuit 704 and outputs an ENB signal to the motor drive circuit 704. With this configuration, the drive motor 604 starts to rotate the toner bottle T. Then, the CPU 701 counts how many times the output signals of the rotation sensor 203 switches from the high level to the low level. When the number of the switching reaches four, the ENB signal input to the motor drive circuit 704 is stopped. With this configuration, the drive motor 604 stops and the rotation of the toner bottle T stops.

When the toner bottle T rotates four revolutions, the CPU 701 proceeds the process to step S202. In step S202, the CPU 701 waits for a predetermined period of time. This is because there is a time lag between a timing that the toner is replenished from the toner bottle T to the developer 100 and a timing that the toner density changes. Then, after a predetermined period of time, the CPU 701 proceeds the process to step S203.

In step S203, the CPU 701 determines whether the toner density D in the developer 100 is lower than the target toner density Dtarget based on the detection result by the toner density sensor 80. In step S203, when the toner density D is equal to or greater than the target toner density Dtarget, the CPU 701 determines that there is still toner in the toner bottle T and proceeds the process to the step S204. In step S204, the CPU 701 cancels the prohibition of the image forming operation and restarts the image forming operation. Then, the CPU 701 ends the ejecting process and proceeds the process to step S100 in the replenishing control illustrated in FIG. 11.

On the other hand, in step S203, when the toner density D is lower than the target toner density Dtarget, the CPU 701 proceeds the process to step S205. In step S205, the CPU 701 determines whether the count value N has reached five. In step S205, when the count value N has not reached five, the CPU 701 proceeds the process to step S206. In step S206, the CPU 701 increments the count value N by one and proceeds the process to step S201.

On the other hand, in a case where the count value N has reached five in step S205, the CPU 701 determines that the toner amount in the toner bottle T is lower than the predetermined amount (Z2) and proceeds the process to step S106 in the replenishing control illustrated in FIG. 11. When the toner density D in the developer 100 is lower than the target toner density Dout after rotating the toner bottle T 20 revolutions, the CPU 701 proceeds the process to step S106 in the replenishing control illustrated in FIG. 11.

Then, when the number of replenishment by the toner bottle T mounted in the mounting portion 310 is equal to or greater than 100 times in step S106, the CPU 701 determines that the toner bottle T mounted in the mounting portion 310 satisfies a replacing requirement and proceeds the process to step S107. With this, the operation unit 706 displays a replacement screen. In other words, the CPU 701 serves as a determination means for determining whether the toner bottle T satisfies the replacing requirement based on the detection result by the toner density sensor 80 and the number of replenishments by the toner bottle T.

Further, when the number of replenishment by the toner bottle T mounted in the mounting portion 310 is less than 100 times in step S106, the CPU 701 detects that a discharge failure has occurred in the toner bottle T mounted in the mounting portion 310. In other words, the CPU 701 serves as an error detection means for detecting a discharge failure in the toner bottle T based on the detection result by the toner density sensor 80 and the number of replenishment by the toner bottle T.

In a case where the ejecting process is executed, the CPU 701 rotates the toner bottle T four revolutions and determines whether the toner density D is equal to or greater than the target toner density Dtarget until the count value N reaches five. The ejecting process does not end unless the toner density D in the developer 100 becomes equal to or greater than the target toner density Dtarget or until the predetermined toner replenishment from the toner bottle T is executed five times.

Then, when there is toner remained in the toner bottle T, the CPU 701 restarts the image forming operation and, when there is no toner remained in the toner bottle T, the CPU 701 displays one of the replacement screen and discharge failure screen on the operation unit 706.

(Display Screen Control after Toner Bottle T is Detached)

Figure 13:
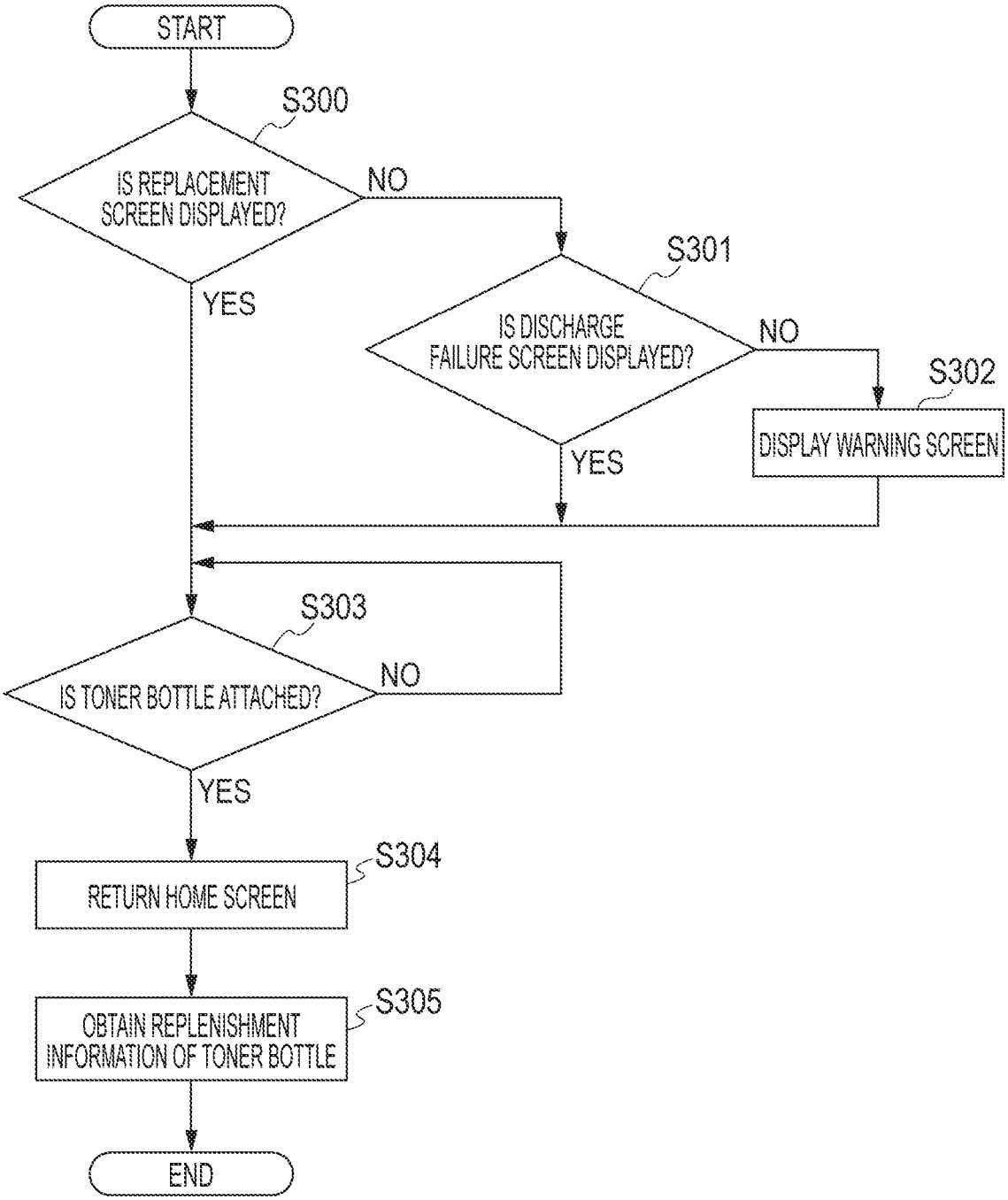
FIG. 13 is a flowchart illustrating a display screen control.

Next, a display screen control after the user detaches the toner bottle T will be described with reference to the control block diagram of FIG. 2 and the flowchart of FIG. 13. Here, the display screen control illustrated in FIG. 13 is executed by that the CPU 701 illustrated in FIG. 2 reads the program stored in the ROM 702. In a case where the bottle sensor 221 detects the detachment of the toner bottle T, the CPU 701 starts a display screen control process illustrated in FIG. 13.

In step S300, the CPU 701 determines whether the replacement screen is being displayed on the operation unit 706. In a case where the toner bottle T is detached from the mounting portion 310, the operation unit 706 may be displaying a replacement screen in step S107 in the replenishing control (FIG. 11).

When the replacement screen is not displayed on the operation unit 706 in step S300, the CPU 701 proceeds the process to step S301. In step S301, the CPU 701 determines whether a discharge failure screen is being displayed on the operation unit 706. In a case where the toner bottle T is detached from the mounting portion 310, the operation unit 706 may be displaying a discharge failure screen in step S108 in the replenishing control (FIG. 11).

When the discharge failure screen is not being displayed on the operation unit 706 in step S301, the CPU 701 proceeds the process to step S302. In step S302, the CPU 701 determines that the toner bottle T is detached when the toner amount in the toner bottle T is greater than the predetermined amount and displays a warning screen on the operation unit 706. Then, the CPU 701 proceeds the process to step S303.

On the other hand, when the replacement screen is displayed on the operation unit 706 in step S300, the CPU 701 proceeds the process to step S303. In other words, when the toner amount remained in the bottle T is equal to or greater than the predetermined amount, the warning screen is not displayed on the operation unit 706 even if the user takes out the toner bottle T from the mounting portion 310. When the toner amount remained in the toner bottle T is equal to or greater than the predetermined amount, the replacement screen is kept being displayed on the operation unit 706 even if the user takes out the toner bottle T from the mounting portion 310.

Further when the discharge failure screen is displayed on the operation unit 706 in step S301, the CPU 701 proceeds the process to step S303. In other words, when a discharge failure has occurred in the toner bottle T, the warning screen is not displayed on the operation unit 706 even if the user takes out the toner bottle T from the mounting portion 310. When a discharge failure has occurred in the toner bottle T, the discharge failure screen is kept being displayed on the operation unit 706 even if the user takes out the toner bottle T from the mounting portion 310. Thus, the user can decide to perform an operation to release an agglutination of the toner in the toner bottle T.

Next, in step S303, the CPU 701 determines whether the toner bottle T is attached. The CPU 701 waits until the bottle sensor 221 detects an attachment of the toner bottle T. Then, when the bottle sensor 221 detects an attachment of the toner bottle T, the CPU 701 proceeds the process to step S304. In step S304, the CPU 701 displays a home screen on the operation unit 706. Then, the CPU 701 proceeds the process to step S305.

In step S305, the CPU 701 controls the reading unit 224 to read the replenishment information from the memory 223 of the toner bottle T mounted in the mounting portion 310. The CPU 701 stores the replenishment information in the RAM 703. After the reading unit 224 reads the replenishment information from the memory 223 in step S304, the CPU 701 ends the display screen control process. After the display screen control is performed, the CPU 701 proceeds the process to step S100 in replenishing control (FIG. 11) again.

The image forming apparatus 200 keeps displaying the discharge failure screen on the operation unit 706 even when the toner bottle T in which a discharge failure has occurred is taken out from the mounting portion 310. Thus, the image forming apparatus 200 can prevent that the user reattaches the toner bottle T without performing an operation to solve the discharge failure.

Further, the image forming apparatus 200 has a configuration to continue displaying the discharge failure screen in a case where the toner bottle T is taken out from the mounting portion 310 while a discharge failure is occurring in the toner bottle T. However, the image forming apparatus 200 may have a configuration to display both of the discharge failure screen and warning screen in a case where the toner bottle T is taken out from the mounting portion 310 while a discharge failure is occurring in the toner bottle T. Also, in this configuration, since the discharge failure screen is kept being displayed on the operation unit 706, this can prevent that the user reattaches the toner bottle T without performing the operation for solving the discharge failure.

Further, the image forming apparatus 200 is configured to include the operation unit 706 which has a touch panel (screen). However, the image forming apparatus 200 may have a configuration to display the discharge failure screen on a monitor of an external device connected to the image forming apparatus 200, as a substitute for the touch panel of the operation unit 706.

Further, in the replenishing control (FIG. 11), the CPU 701 prohibits an execution of a toner replenishment when the time passed since a previous toner replenishment is executed is shorter than the prohibition time (S103). The above processes from step S101 to step S103 is simply an example. For example, when the toner density D is lower than the threshold value Dtarget in step S101, the CPU 701 may control the drive motor 604 to rotate the toner bottle T. When there is toner remained in the toner bottle T, the toner is supplied from the toner bottle T to the developer 100.

According to the aspect of the embodiments, the usability can be improved in an image forming apparatus in which a container containing a developing material is detachable.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-079955, filed Apr. 13, 2017, which is hereby incorporated by reference herein in its entirety.

What is claimed is:

1. An image forming apparatus comprising:

an image former configured to form an image with a developing material;

a sensor configured to detect the developing material in the image former, wherein the sensor is provided on the image former;

a mounting portion on which a container is mounted, the container containing the developing material;

a processor configured to determine a replenishing error of the container based on the detection result by the sensor; and a display configured to:

display a warning screen to prompt a reattachment of the container detached from the mounting portion, in a case where the container is detached from the mounting portion while a replacement condition is not satisfied; and display a discharge failure screen to prompt an execution of an operation for solving the replenishing error, in a case where the replenishing error is determined by the processor, wherein the display displays the discharge failure screen, in a case where the container is detached from the mounting portion while the replacement condition is not satisfied after the replenishing error is determined by the processor.

2. The apparatus according to claim 1, wherein the processor controls whether to stop an image forming operation by the image former and execute a predetermined replenishing operation, based on the detection result by the sensor.

3. The apparatus according to claim 1, wherein the processor controls the sensor to detect the developing material after executing the predetermined replenishing operation and determines the replenishing error in a case where a predetermined condition is satisfied, and wherein the replenishing error is determined in the predetermined condition where the developing material is not increased and a number of replenishments executed from the container is less than a predetermined number.

4. The apparatus according to claim 1, wherein the display displays, in a case where the replacement condition is satisfied, a replacement screen to prompt a replacement of the container.

5. The apparatus according to claim 1, wherein the processor replenishes the developing material from the container to the image former, based on the detection result.

6. The apparatus according to claim 1, wherein in a case where the container is detached from the mounting portion while the replacement condition is not satisfied after the replenishing error is determined by the processor, the display displays the discharge failure screen without displaying the warning screen.

7. The apparatus according to claim 1, wherein in a case where the replenishing error is determined by the processor, the display displays the discharge failure screen before the container is detached from the mounting portion.

8. The apparatus according to claim 1, wherein the display displays a predetermined screen, which is different from the warning screen, after the container is reattached to the mounting portion.

9. The apparatus according to claim 1, wherein the processor drives a pump of the container and replenishes the developing material from the container.

10. The apparatus according to claim 1, further comprising a motor configured to be driven to replenish the developing material from the container, wherein the processor drives the motor to expand and contract a pump of the container.

11. The apparatus according to claim 1, wherein the image former includes a first developing unit configured to store a developing material of a first color, a second developing unit configured to store a developing material of a second color, a third developing unit configured to store a developing material of a third color, and a fourth developing unit configured to store a developing material of a fourth color, wherein the mounting portion includes a first mounting portion to which a first container containing the developing material of the first color is mounted, a second mounting portion to which a second container containing the developing material of the second color is mounted, a third mounting portion to which a third container containing the developing material of the third color is mounted, and a fourth mounting portion to which a fourth container containing the developing material of the fourth color is mounted, wherein the processor determines a remaining amount of the developing material in the first container, wherein the processor determines a replenishing error in the first container, wherein in a case where the replacement condition is not satisfied, the display displays the screen to prompt a reattachment of the first container detached from the first mounting portion while the first container is not in the first mounting portion, and wherein in a case where the replacement condition is satisfied, the display displays the screen to prompt an execution of an operation to solve the replenishing error while the first container is not in the first mounting portion.

12. The apparatus according to claim 1, wherein the warning screen to prompt a reattachment of the container detached from the mounting portion includes information related to the detached container.

13. The apparatus according to claim 12, wherein the information corresponds to information that indicates the color of the developing material contained in the container detached from the mounting portion.

14. The apparatus according to claim 1, wherein the processor determines whether or not the replacement condition is satisfied based on the detection result of the sensor.

15. An image forming apparatus comprising:

an image former configured to form an image with a developing material;

a sensor configured to detect the developing material in the image former;

a portion to which a container is attached, the container containing the developing material;

a processor configured to:

control replenishment operation in which the developing material is replenished to the image former from the container attached to the portion; and determine a replenishment error of the container based on the detection result by the sensor; and a display configured to:

display a warning screen to prompt a reattachment of the container detached from the portion, in a case where (a) the container is detached from the portion and (b) a replacement condition is not satisfied; and display a discharge failure screen to notify of the replenishment error, in a case where the replenishment error is determined by the processor, wherein the display displays the discharge failure screen, in a case where (c) the container is detached from the portion, (d) the replacement condition is not satisfied, and (e) the replenishment error is determined by the processor.

16. The apparatus according to claim 15, wherein the processor determines whether or not the replacement condition is satisfied based on the detection result of the sensor.

17. The apparatus according to claim 15, wherein the display displays, in a case where the replacement condition is satisfied, a replacement screen to prompt a replacement of the container.

18. The apparatus according to claim 15, wherein the display displays the discharge failure screen without displaying the warning screen, in a case where (f) the container is detached from the portion, (g) the replacement condition is not satisfied, and (h) the replenishment error is determined by the processor.

19. The apparatus according to claim 15, wherein the display displays a predetermined screen, which is different from the warning screen, in a case where the container is reattached to the portion.

20. The apparatus according to claim 15, further comprising a motor configured to drive the container attached to the portion, wherein the processor controls the motor in the replenishment operation.

* * * * *